US009196147B1

(12) United States Patent
Sommer et al.

(10) Patent No.: US 9,196,147 B1
(45) Date of Patent: Nov. 24, 2015

(54) AUTOMATED OBJECT ANALYSIS SYSTEM

(71) Applicant: The Boeing Company, Chicago, IL (US)

(72) Inventors: Nathanael Sommer, Madison, AL (US); Peter S. Wittenberg, Creve Coeur, MO (US)

(73) Assignee: THE BOEING COMPANY, Chicago, IL (US)

( * ) Notice: Subject to any disclaimer, the term of this patent is extended or adjusted under 35 U.S.C. 154(b) by 103 days.

(21) Appl. No.: 13/911,630

(22) Filed: Jun. 6, 2013

(51) Int. Cl.
*G08B 13/00* (2006.01)
*G08B 21/18* (2006.01)

(52) U.S. Cl.
CPC ..... *G08B 21/18* (2013.01)

(58) Field of Classification Search
CPC ..... B25J 5/00; B25J 9/1676; G05D 1/0251; G05D 1/0274; G05D 2201/0211; G06F 2203/04101; G06F 3/017; G06F 3/0304; G06F 3/0416; G06F 3/0425; G06F 3/04883; H04W 36/14; H04W 36/32; H04W 84/04
USPC ..... 340/541, 573.1, 552, 554, 567, 522, 340/506, 539, 568.1, 3.1
See application file for complete search history.

(56) References Cited

U.S. PATENT DOCUMENTS

| | | | | |
|---|---|---|---|---|
| 6,307,475 | B1 * | 10/2001 | Kelley | 340/573.1 |
| 2007/0009104 | A1 * | 1/2007 | Renkis | 380/270 |
| 2009/0015671 | A1 * | 1/2009 | Addy | 348/143 |
| 2009/0254004 | A1 * | 10/2009 | Graichen et al. | 600/595 |
| 2009/0296991 | A1 * | 12/2009 | Anzola | 382/107 |
| 2013/0057384 | A1 * | 3/2013 | Morris et al. | 340/5.74 |

* cited by examiner

*Primary Examiner* — Daniel Previl
(74) *Attorney, Agent, or Firm* — Yee & Associates, P.C.

(57) ABSTRACT

A method and apparatus for analyzing movement of objects in a border area. Information about the movement of the objects in the border area is identified from sensor data. The information about the movement of the objects in the border area is compared with movement information for the border area to form a comparison. An alert is generated when the comparison indicates that an object of interest in the objects is present.

22 Claims, 9 Drawing Sheets

AUTOMATED OBJECT ANALYSIS SYSTEM

BACKGROUND INFORMATION

1. Field

The present disclosure relates generally to identifying objects of interest and, in particular, to perimeter surveillance for identifying objects of interest. Still more particularly, the present disclosure relates to a method and apparatus for perimeter surveillance for identifying objects of interest from traffic in an area.

2. Background

Perimeters are boundaries that divide areas that are often monitored to ensure a desired level of security and access between areas. For example, with a perimeter such as a border between two countries, border security is important for controlling traffic along the border between the two countries. Border security is used to control the movement of vehicles, people, and other objects between the borders of the two countries.

As another example, with a perimeter around an area such as a camp, a base, or a group of buildings, perimeter surveillance is important for ensuring a desired level of security or protection for the camp or the group of buildings. In a military application, this is known as force protection.

Border surveillance includes obtaining information about the movement of objects across or near a border. Border surveillance involves obtaining information to identify potential threats, intrusions, and unauthorized crossings of a border.

Sensor systems generate information about the movement of objects across or near a border. The sensor systems may include visible light cameras, infrared cameras, radar systems, motion sensors, pressure sensors, smart fences, unattended ground sensors, and other suitable types of sensors. The sensor systems may generate information in an area including a border, an area near the border, or some other area of interest.

Human operators review the information generated by sensor systems and determine whether an object of interest is present that may require additional investigation, interception, or some other action.

Information is often in the form of tracks displayed on a display device. The tracks are indications of movement of one or more objects in an area. These tracks may be located on roads, bridges, prairie, desert, water, or other types of terrain within an area. Human operators gain experience when monitoring information for a particular area over time. For example, a human operator may over time gain knowledge of when certain tracks do not indicate an object of interest. Further, a human operator also may receive training about tracks in a particular area from other operators who are experienced with monitoring information for the area. In this manner, a human operator may identify that tracks generated on a particular time and day over a particular location in an area may represent traffic from objects that are not of interest.

For example, a human operator may realize from experience, training, or both, that tracks across the road and through the pasture may be for cattle. As another example, a human operator also may realize that tracks on a particular road at a particular time represent vehicles that are authorized to be present. On the other hand, an inexperienced operator may not realize that these types of tracks were not made by objects of interest.

Without the experience, training, or both, the operator may falsely identify that these tracks are for objects of interest. As a result, investigations of these tracks may occur more often than needed because of false positives.

Time and expense is needed for the experience, training, or both, needed for reducing the occurrence of objects being identified as objects of interest when they are actually not of interest. As a result, extra operators may be needed until newer operators can gain the experience and training for a particular border area.

Further, when a human operator is moved from one area to a new area, that human operator will require time to learn about the traffic in the new area. As a result, more objects may be identified as objects of interest than desired while the human operator gains experience in the new area.

Identifying these undesired objects is called a false alarm. An inexperienced operator may also mistake objects of interest for ordinary traffic. This mistake is called a miss. Both false alarms and misses are problems in perimeter surveillance, whether the perimeter is a border between countries or around an area such as a group of buildings. With a false alarm, resources are wasted in responding to the false alarm. With a miss, intrusion across the perimeter is not prevented or managed.

Therefore, it would be desirable to have a method and apparatus that take into account at least some of the issues discussed above, as well as other possible issues.

SUMMARY

An illustrative embodiment of the present disclosure provides a method for analyzing movement of objects in a border area. Information about the movement of the objects in the border area is identified from sensor data. The information about the movement of the objects in the border area is compared with movement information for the border area to form a comparison. An alert is generated when the comparison indicates that an object of interest in the objects is present.

In another illustrative embodiment, a method for analyzing movement of objects in an area is present. Information about the movement of the objects in the area is identified from sensor data. The information about the movement of the objects in the area is compared with movement information for the area to form a comparison. An alert is generated when the comparison indicates that an object of interest in the objects is present.

In yet another illustrative embodiment, an apparatus comprises an object analyzer. The object analyzer is configured to identify information about movement of objects in a border area from sensor data. The object analyzer is further configured to compare the information about the movement of the objects in the border area with movement information for the border area to form a comparison. The object analyzer is still further configured to generate an alert when the comparison indicates that an object of interest in the objects is present.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account one or more different considerations. For example, the illustrative embodiments recognize and take into account that an object analysis system may be used to reduce the time needed by a human operator to learn a new area. The illustrative items recognize and take into account that reducing false indications of a presence of objects of interest may reduce the cost needed to monitor and enforce security at a border area. The illustrative embodiments also recognize and take into account that preventing misses may increase the effectiveness of the system required for security of perimeters such as those around the building and those that divide countries as well as other types of perimeters.

One or more illustrative embodiments provide a method and apparatus for analyzing the movement of objects in an area. One illustrative embodiment may be implemented for analyzing movement of objects in a perimeter area.

For example, a perimeter area in the illustrative examples is an area of land that includes a border between two countries or may be an area that is proximate to the border and may include traffic that crosses the border. This type of perimeter area may also be referred to as a border area. In some examples, the border may be between two other types of entities such as states or provinces. In still other illustrative examples, the area may include a body of water such as a river, a lake, an ocean, or some other suitable body of water.

In the illustrative examples, perimeter surveillance refers to protecting an area from intrusion. This type of surveillance may be for all types of terrain, and water may be contained within the perimeter surveillance area.

Information about the movement of objects in an area is identified by sensor data. Information about the movement of objects within the area compared to movement information for the area forms a comparison. Alerts are generated when the comparison indicates an object of interest is present in the objects.

Figure 1:
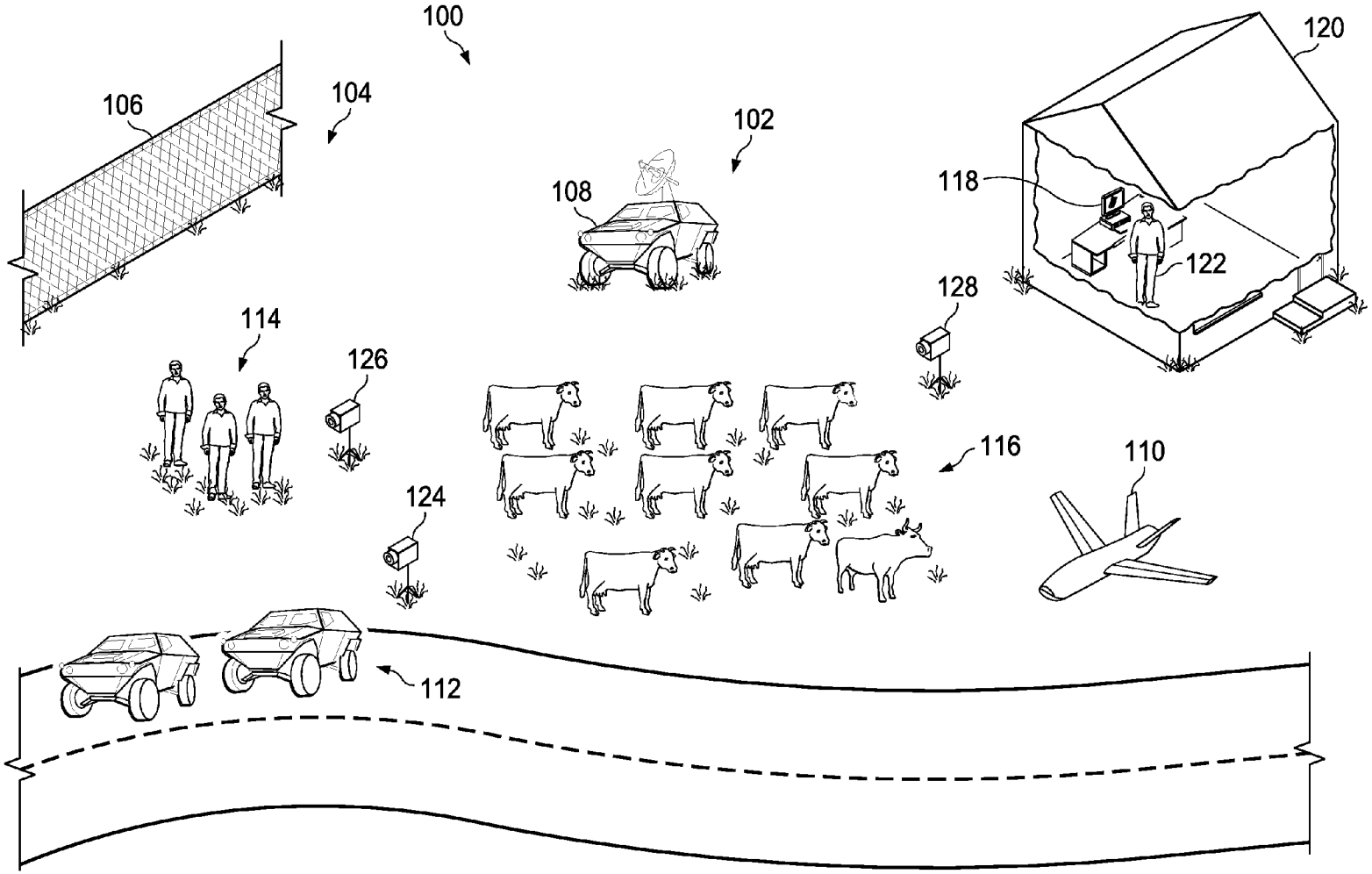
FIG. 1 is an illustration of a border surveillance environment in accordance with an illustrative embodiment.

With reference now to the figures and, in particular, with reference to FIG. 1, an illustration of a border surveillance environment is depicted in accordance with an illustrative embodiment. In this illustrative example, border surveillance environment 100 includes border area 102. As depicted, border area 102 includes border 104 defined by fence 106.

Monitoring of border area 102 may be performed using a sensor system that includes ground radar unit 108 and unmanned aerial vehicle 110. In this illustrative example, ground radar unit 108 and unmanned aerial vehicle 110 are part of a radar system that generates sensor data about the movement of objects in border area 102. In this illustrative example, these objects include trucks 112, people 114, and cattle 116.

The sensor data may be sent to computer 118 located in building 120. Building 120 is shown as being within border area 102 in this illustrative example. Operator 122 may view the sensor data on computer 118 to determine whether one or more objects of interest are present in border area 102.

In the illustrative examples, when computer 118 is implemented in accordance with an illustrative embodiment, computer 118 provides an analysis of the sensor data to aid operator 122 in determining whether an object of interest is present in the objects detected in the sensor data. In particular, computer 118 may be configured to compare information about the movement of objects within border area 102 with movement information for border area 102 to perform a comparison.

In the illustrative examples, this movement information may include tracks for movement of objects that have been identified as either being not of interest or of interest. These tracks, along with other information, may form patterns from which comparisons may be made with tracks for movement of objects detected by sensors, such as ground radar unit 108 and unmanned aerial vehicle 110. Computer 118 is configured to generate an alert if the comparison indicates that an object of interest in the object is present.

For example, computer 118 may receive sensor data generated by at least one of ground radar unit 108 and unmanned aerial vehicle 110. As used herein, the phrase "at least one of," when used with a list of items, means different combinations of one or more of the listed items may be used and only one of each item in the list may be needed. For example, "at least one of item A, item B, or item C" may include, without limitation, item A, item A and item B, or item B. This example also may include item A, item B, and item C or item B and item C. Of course, any combinations of these items may be present. In other examples, "at least one of" may be, for example, without limitation, two of item A, one of item B, and ten of item C; four of item B and seven of item C; and other suitable combinations. The item may be a particular object, thing, or a category. In other words, at least one of means any combination of items and number of items may be used from the list but not all of the items in the list are required.

This sensor data may include information about the movement of trucks 112, people 114, and cattle 116. The sensor data is analyzed by computer 118 to determine whether an object of interest is present in these different objects. Computer 118 is configured to generate an alert to operator 122 if an object of interest is identified.

In the illustrative examples, the operation of computer 118 to analyze sensor data and generate alerts is performed while trucks 112, people 114, and cattle 116 are moving within border area 102. As depicted, the sensor data is sent to computer 118 and computer 118 processes the sensor data as quickly as possible without intentional delays. This type of processing may take the form of real-time processing with respect to generating alerts about objects of interest.

When an alert is present, operator 122 may perform a number of actions. For example, operator 122 may view images from at least one of camera 124, camera 126, and camera 128 to view objects such as trucks 112, people 114, and cattle 116. The sensor data in these illustrative examples do not provide a level of detail that allows operator 122 to identify the objects in more detail. For example, operator 122 may not actually identify objects as trucks 112, people 114, and cattle 116. In other words, the sensor data does not necessarily provide sufficient information to identify the fact that cattle 116 are present. Instead, sensor data may only indicate the presence of objects, the speed of travel, and the path along which they travel. As another example, the sensor data for people 114 may be able to identify that people are present, but may not be able to determine whether the people are authorized to be in border area 102. Camera 126 may be used to make a further verification.

In addition, operator 122 may take other actions. For example, operator 122 may send other operators, such as border security, to investigate people 114. As yet another example, operator 122 may direct unmanned aerial vehicle 110 to obtain images of people 114 if camera 126 is unable to generate more images of people 114 of a desired quality.

The illustration of border surveillance environment 100 is only provided as an example of one manner in which an illustrative embodiment may be implemented. For example, in other illustrative embodiments, other numbers of devices, vehicles, or other units may be used in a sensor system to generate information about the movement of objects. In still other illustrative examples, building 120 with operator 122 may be located in a location remote to border area 102. In yet other illustrative examples, border area 102 may include bodies of water such as a lake, a river, a creek, or other bodies of water.

In yet other illustrative examples, border area 102 may not have fence 106 defining border 104. Instead, a natural feature such as a river may define border 104. In other illustrative examples, border 104 may be arbitrarily defined without any features indicating border 104.

Figure 2:
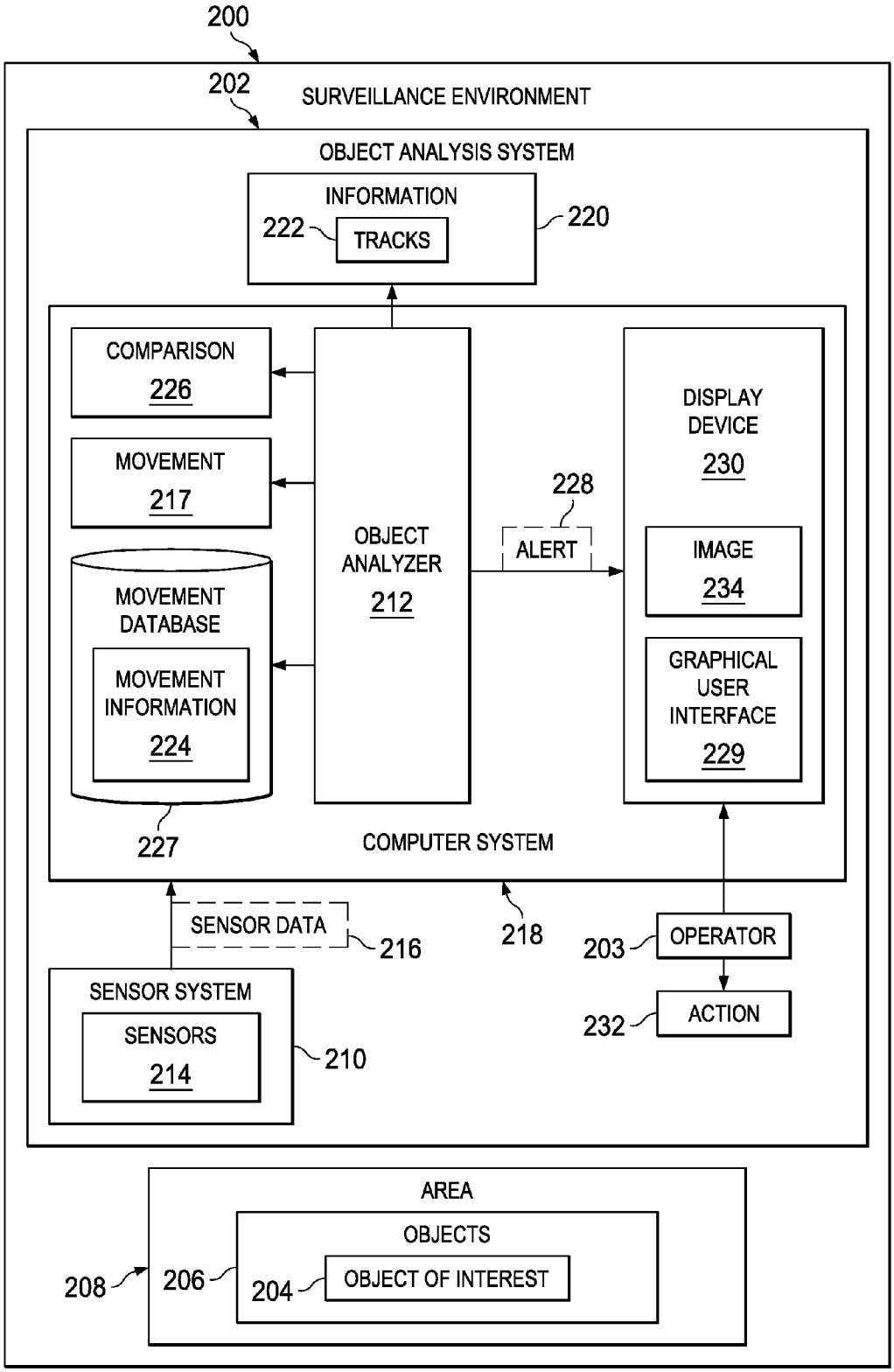
FIG. 2 is an illustration of a block diagram of a surveillance environment in accordance with an illustrative embodiment.

With reference now to FIG. 2, an illustration of a block diagram of a surveillance environment is depicted in accordance with an illustrative embodiment. Border surveillance environment 100 is an example of one implementation for surveillance environment 200 in FIG. 2.

As depicted, surveillance environment 200 includes object analysis system 202. Object analysis system 202 is configured to aid operator 203 in identifying object of interest 204 from objects 206 in area 208. Area 208 may take various forms. For example, area 208 may be selected from at least one of a border area, a parking area, a forest, a field, an underwater area, or other suitable types of areas.

In this illustrative example, object analysis system 202 includes one or more different components. As depicted, object analysis system 202 includes sensor system 210 and object analyzer 212.

Sensor system 210 is comprised of a group of sensors 214. As used herein, a "group of," when used with reference items, means one or more items. For example, a group of sensors 214 is one or more sensors.

In this illustrative example, sensor system 210 is configured to generate sensor data 216 from objects 206 in area 208. In these illustrative examples, sensor data 216 does not take the form of images of objects 206. Instead, sensor data 216 provides information to identify movement 217 of objects 206. Sensor data 216 may be, for example, radar data. In this form, sensor data 216 provides information such as at least one of a location, a time, a path, or other suitable information about the movement of objects 206. Sensor data 216 is then sent to object analyzer 212.

As depicted, object analyzer 212 may be implemented in software, hardware, firmware or a combination thereof. When software is used, the operations performed by object analyzer 212 may be implemented in program code configured to run on a processor unit. When firmware is used, the operations performed by object analyzer 212 may be implemented in program code and data and stored in persistent memory to run on a processor unit. When hardware is employed, the hardware may include circuits that operate to perform the operations in object analyzer 212.

In the illustrative examples, the hardware may take the form of a circuit system, an integrated circuit, an application specific integrated circuit (ASIC), a programmable logic device, or some other suitable type of hardware configured to perform a number of operations. With a programmable logic device, the device may be configured to perform the number of operations. The device may be reconfigured at a later time or may be permanently configured to perform the number of operations. Examples of programmable logic devices include, for example, a programmable logic array, a programmable array logic, a field programmable logic array, a field programmable gate array, and other suitable hardware devices. Additionally, the processes may be implemented in organic components integrated with inorganic components and/or may be comprised entirely of organic components excluding a human being. For example, the processes may be implemented as circuits in organic semiconductors.

In this illustrative example, object analyzer 212 may be implemented in computer system 218. Computer system 218 is comprised of one or more computers. When more than one computer is present in computer system 218, those computers may be in communication with each other through a communications medium such as a network.

In this illustrative example, object analyzer 212 is configured to identify information 220 about movement 217 of objects 206 in area 208. In particular, information 220 about movement 217 of objects 206 in area 208 takes the form of tracks 222 for objects 206.

In the illustrative example, a track in tracks 222 contains information about the movement of an object. This information may be derived from the sensors, entered by the operator, or both. A track in tracks 222 also may include information about the object. Object analyzer 212 is configured to compare information 220 about movement 217 of objects 206 in area 208 with movement information 224 for area 208 to form comparison 226.

In this illustrative example, movement information 224 may be located in movement database 227, which will contain all the track information from all the sensors for the times and areas of interest. Movement database 227 may be in a single location or may be distributed in different locations.

Alert 228 is generated by object analysis system 202 when comparison 226 indicates that object of interest 204 in objects 206 is present. In the illustrative example, alert 228 may be displayed on graphical user interface 229 on display device 230 in computer system 218. Alert 228 may include other forms in addition to or in place of being displayed on graphical user interface 229. For example, alert 228 may be an audible alert. For example, the alert may be selected from one of a graphical indicator, a sound, or text, indicating a presence of the object of interest, graphically indicating a path of movement as being for the object of interest, or other suitable types of alerts.

In this illustrative example, alert 228 is configured to obtain the attention of operator 203. Operator 203 may then perform action 232. Action 232 may include performing additional investigations.

For example, operator 203 may review image 234 of object of interest 204 to identify object of interest 204. As depicted, image 234 also may be generated by sensor system 210. In another illustrative example, operator 203 may send personnel, unmanned vehicles, or other devices to perform more detailed investigations or to intercept object of interest 204.

Figure 3:
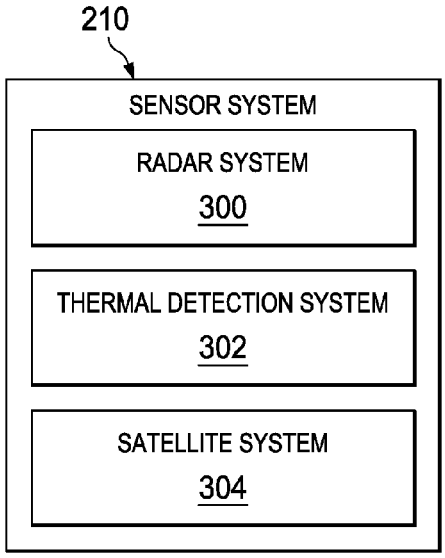
FIG. 3 is an illustration of a block diagram of a sensor system in accordance with an illustrative embodiment.

With reference next to FIG. 3, an illustration of a block diagram of a sensor system is depicted in accordance with an illustrative embodiment. An example of components that may be used in sensor system 210 is depicted in this figure.

In this depicted example, sensor system 210 may be implemented using a number of different components. For example, sensor system 210 may include at least one of radar system 300, thermal detection system 302, satellite system 304, or other suitable components.

Radar system 300 may be at least one of a ground radar system or an airborne radar system. A ground radar system may include one or more fixed units such as radar stations. An airborne radar system may include at least one of an unmanned aerial vehicle, manned aerial vehicle, or other suitable types of airborne vehicles or devices. Radar system 300 is configured to generate radar data about the movement of objects 206.

In the illustrative example, thermal detection system 302 also may be based on the ground, in the air, or both. Thermal detection system 302 may be in fixed locations or may be associated with vehicles that may move. Thermal detection system 302 may identify the presence of objects 206 in area 208 from thermal signatures and also may identify movement 217 of objects 206 as seen in FIG. 2.

Satellite system 304 includes one or more satellites. These satellites may provide images or video of objects 206 that may be used to identify movement 217 of objects 206.

Figure 4:
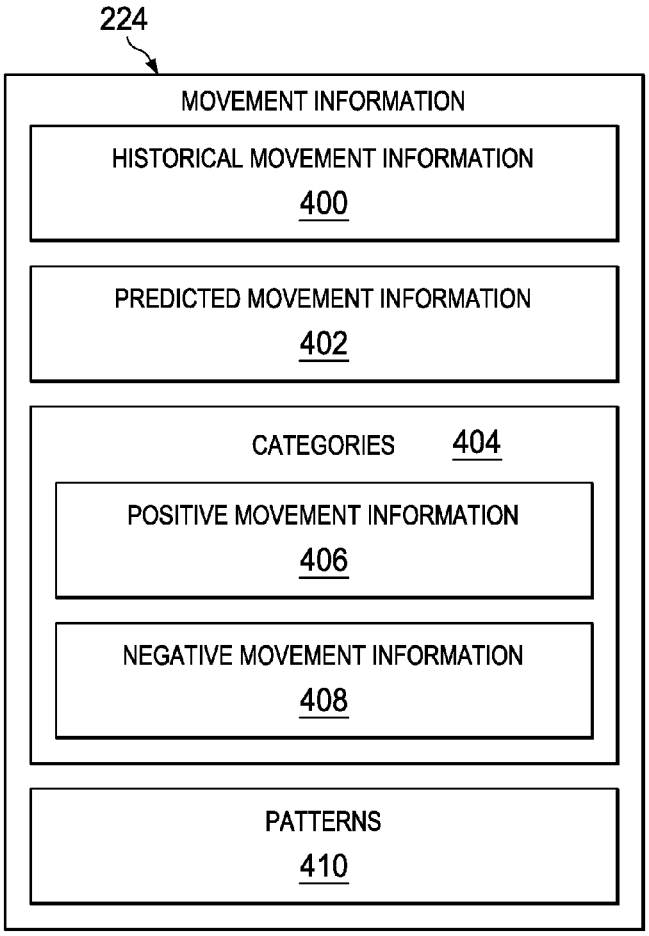
FIG. 4 is an illustration of a block diagram of movement information in accordance with an illustrative embodiment.

Turning now to FIG. 4, an illustration of a block diagram of movement information is depicted in accordance with an illustrative embodiment. As depicted, movement information 224 may take different forms. For example, movement information 224 may comprise at least one of historical movement information 400, predicted movement information 402, or other suitable types of information.

In these illustrative examples, historical movement information 400 is information about movement that has occurred previously. For example, historical movement information 400 may be information about tracks 222 that have previously occurred in area 208 as seen in FIG. 2. Historical movement information 400 may be previously analyzed.

Predicted movement information 402 may be generated from simulations of movement within area 208. The simulations may be based on historical movement information 400 or other sources.

Movement information 224 may have categories 404. As depicted, categories 404 may include at least one of positive movement information 406, negative movement information 408, or other suitable types of movement information. Positive movement information 406 is movement information for objects indicating objects that are objects of interest. Negative movement information 408 is movement information indicating objects that are not objects of interest. In other words, negative movement information 408 indicates an absence of objects of interest.

In these illustrative examples, movement information 224 may include patterns 410. Patterns 410 may be patterns for tracks 222 that have been previously analyzed. Patterns 410 may be based on location, time, date, path and other suitable information. As another illustrative example, patterns 410 may be based on the path on which the objects travel.

For example, if the path traveled by objects is a commonly used paved road, then traffic on the paved road at particular times may not indicate the presence of an object of interest. If the path is a dirt road, and the objects travel on that dirt road during hours on which traffic is not expected on the dirt road, then objects traveling at those times may be considered objects of interest. This type of information as well as other information may be incorporated into patterns 410 for use in determining whether object of interest 204 is present in objects 206.

In one illustrative embodiment, object analyzer 212 in FIG. 2 may be implemented using a rule-based system. In the rule-based system, object analyzer 212 may use a set of rules that define which objects are of interest and which objects are not of interest based on historical movement information 400 in FIG. 4. A general set of rules to identify objects of interest may be present in object analyzer 212 when object analyzer 212 is initially installed.

For example, an object traveling faster than the speed limit will often be an object of interest. A walker going through a forbidden area is also an object of interest. The rules may be modified to fit the requirements of specific sites. For example, if a vehicle travels on the same road at the same time each day, and it has been determined by the operator that this is not an object of interest, object analyzer 212 adds a rule finding that such objects are not of interest. Once the rule is placed in object analyzer 212, operator 203 no longer needs to examine this vehicle in detail.

The rule-based system can be tailored so that each individual operator can install their own rules according to how they can be most effective for the operator. The process of creating rules for the rule-based system may also include a "learning" system that creates new rules based on which tracks the operator has decided are of interest and which ones are not. In creating these rules, object analyzer 212 may use any combination of features from historical movement information 400 that make an effective rule.

Figure 5:
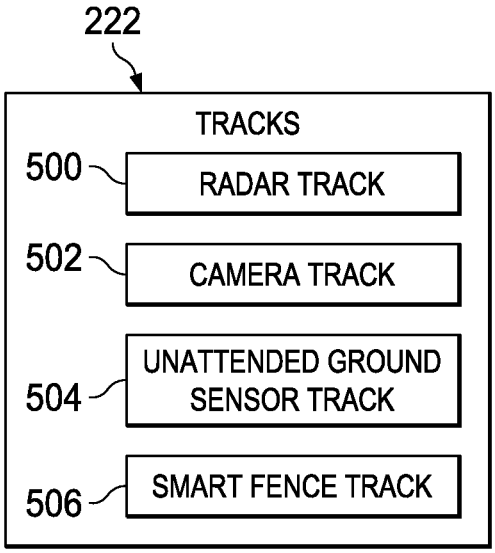
FIG. 5 is an illustration of types of tracks in accordance with an illustrative embodiment.

With reference now to FIG. 5, an illustration of types of tracks is depicted in accordance with an illustrative embodiment. In this illustrative example, tracks 222 may include different types of tracks. For example, tracks 222 may include radar track 500, camera track 502, unattended ground sensor track 504, and smart fence track 506. These different types of tracks all include information about the movement of an object and also include other information about the object.

As depicted, radar track 500 may include information obtained from a radar system. Radar track 500 contains entries for the radar track initiation and for each track update. The radar track initiation is the first information obtained for an object from a radar system. The track updates are subsequent information received from the radar system for the object.

In this illustrative example, each entry for a radar track includes a time tag, the target position, and the target velocity. The radar track also may include type information about the target. The time tag indicates when the observation was made. The target position may be described using latitude, longitude, and altitude. Of course, other coordinate systems may be used. These different entries may define a path of movement for an object.

In this example, camera track 502 may be generated from information received from a camera system. The camera system may include visible light cameras, infrared cameras, and other suitable types of cameras. Camera track 502 includes information similar to radar track 500. Camera track 502 may also include target angle information and range to the target. Camera track 502 may also contain images of the target being tracked. These images may be, for example, still images, video images, or some combination thereof.

In the illustrative example, unattended ground sensor track 504 includes information from a ground sensor system. The ground sensor system may include visible light cameras, infrared cameras, radar systems, motion sensors, pressure sensors, smart fences, unattended ground sensors, and other suitable types of sensors. Unattended ground sensor track 504 includes a history of time and target location. In the illustrative example, unattended ground sensor track 504 may also include type information about the target.

In still another illustrative example, smart fence track 506 includes information from a fence with a sensor system. This type of fence includes sensors that generate information about disturbances made to the fence. Smart fence track 506 includes information about the location of an object disturbing the fence and a time tag for each disturbance. Additionally, this type of track also may include identification information about the object.

The illustration of surveillance environment 200 and the different components in FIGS. 2-5 are not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, operator 203 may monitor other areas in addition to or in place of area 208. In another illustrative example, surveillance environment 200 may include other operators. These operators may perform actions such as further investigation or interception of object of interest 204.

Figure 6:
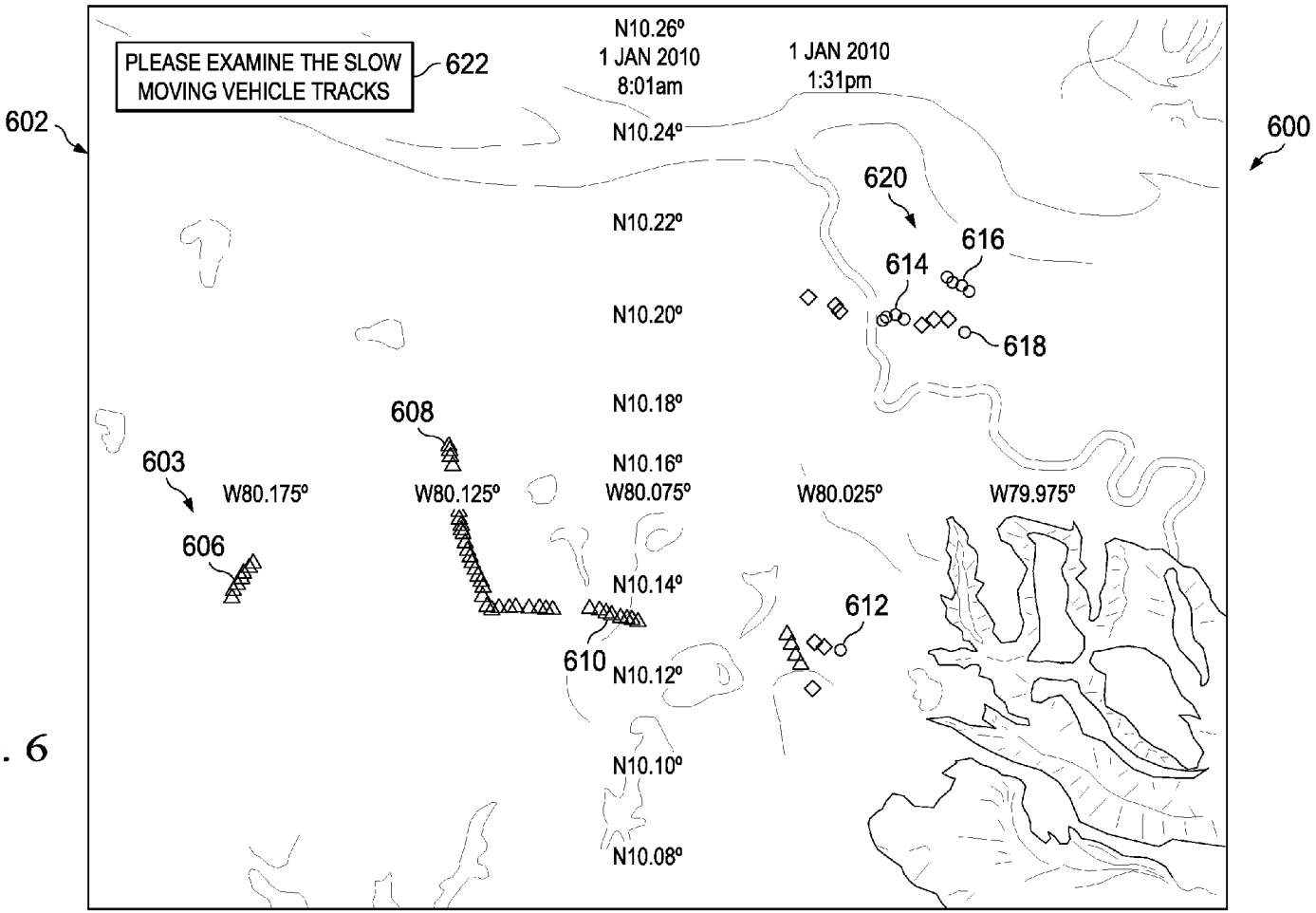
FIG. 6 is an illustration of a graphical user interface with an alert in accordance with an illustrative embodiment.

Turning next to FIG. 6, an illustration of a graphical user interface with an alert is depicted in accordance with an illustrative embodiment. In this illustrative example, graphical user interface 600 is an example of one implementation for graphical user interface 229 shown in block form in FIG. 2.

As depicted, area 602 is a land area displayed in graphical user interface 600. Tracks 603 are displayed in area 602 and are examples of tracks 222 shown in block form in FIG. 2. In this illustrative example, tracks 603 include track 606, track 608, track 610, track 612, track 614, track 616, and track 618. In this illustrative example, tracks 603 represent information about the movement of various objects.

Track 606 and track 608 are for vehicles moving at about 10 m/s to about 12 m/s. Track 610 and track 612 are also vehicle tracks of vehicles moving from about 10 m/s to about 12 m/s. Track 614, track 616, and track 618 are for slower moving vehicles in this illustrative example. As seen, an alert in the form of graphical indicator 620 indicates that track 614, track 616, and track 618 are for objects of interest.

In this illustrative example, graphical indicator 620 takes the form of cross hatching on track 614, track 616, and track 618. Of course, graphical indicator 620 may take other forms depending on the particular implementation. For example, graphical indicator 620 may include at least one of color, highlighting, bolding, animation, text, icons, or other suitable types of indicators that may draw the attention of the operator.

Additionally, the alert in this illustrative example also includes text 622. Text 622 requests examination of the slow-moving vehicle tracks in tracks 603. These slow moving vehicle tracks are track 614, track 616, and track 618 in this illustrative example.

As a result, the operator may perform various actions in response to the alert. For example, the operator may activate cameras in the area of track 614, track 616, and track 618. The operator may view images generated by the cameras. These images may be, for example, still images or video images of objects generating track 614, track 616, and track 618. The operator may, in addition to or in place of viewing images, send out other operators to investigate the vehicles generating the track 614, track 616, and track 618.

In this illustrative example, object analysis system 202, operator 203, or both are able to identify these tracks as being generated by vehicles. However, operator 203 and object analysis system 202 are unable to identify whether vehicles are authorized or unauthorized vehicles.

Figure 7:
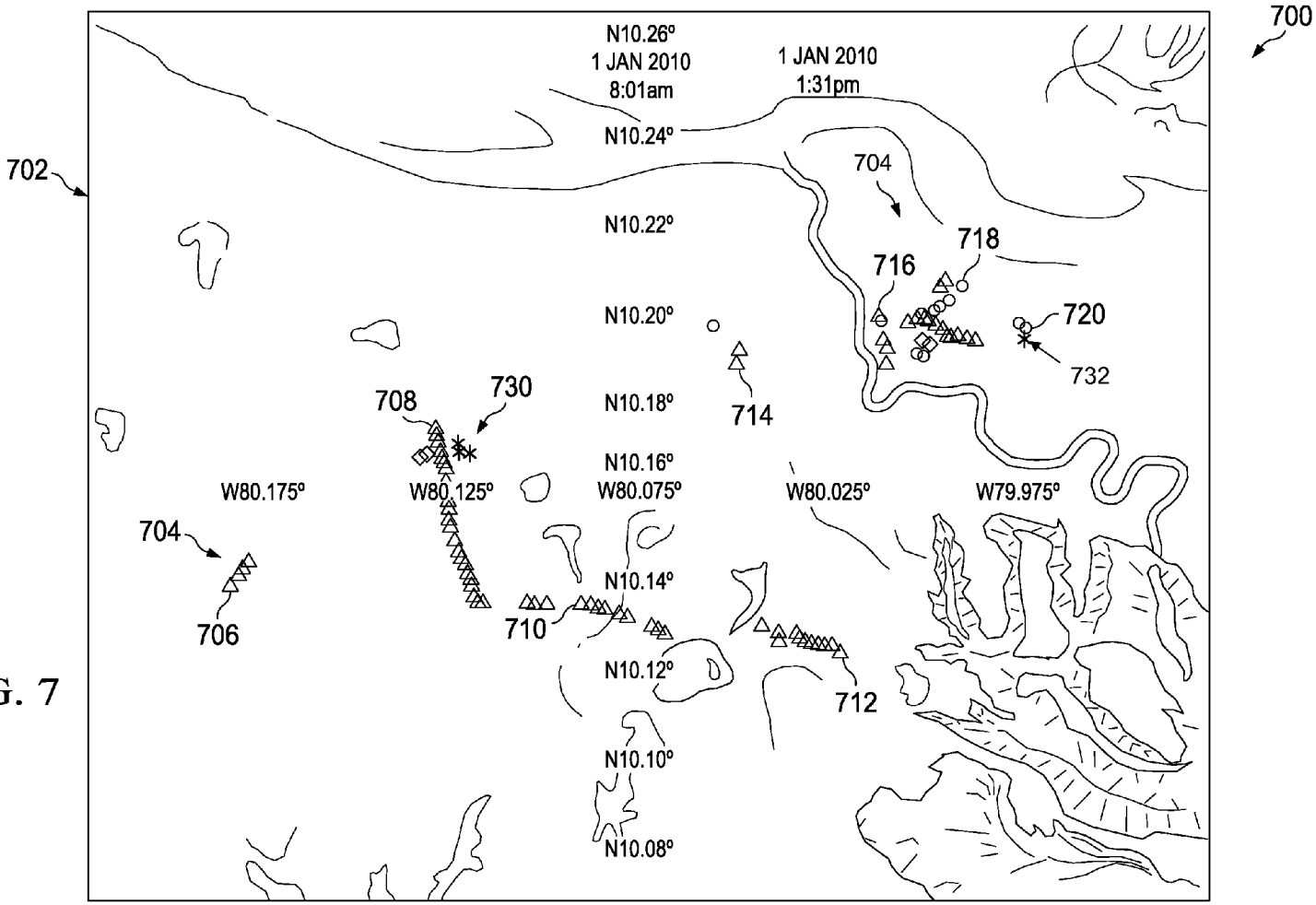
FIG. 7 is another illustration of a graphical user interface with an alert in accordance with an illustrative embodiment.

With reference next to FIG. 7, another illustration of a graphical user interface with an alert is depicted in accordance with an illustrative embodiment. In this illustrative example, graphical user interface 700 is another example of an implementation for graphical user interface 229 in FIG. 2.

As depicted, area 702 of the land area is displayed on graphical user interface 700. Additionally, tracks 704 are also displayed in graphical user interface 700.

In this illustrative example, tracks 704 are examples of tracks 222 shown in block form in FIG. 2. As depicted, tracks 704 include track 706, track 708, track 710, track 712, track 714, track 716, track 718, and track 720. In this illustrative example, an alert is displayed on graphical user interface 700. Graphical indicator 730 is displayed in association with track 708. Graphical indicator 732 is displayed in association with track 716, track 718, and track 720 in tracks 704, which are for objects of interest.

Graphical indicators are considered to be displayed in association with a track when the graphical indicator draws the attention of the operator viewing tracks 704 on graphical user interface 700.

The illustration of graphical user interface 600 in FIG. 6 and graphical user interface 700 in FIG. 7 are only provided as examples of some implementations for graphical user interface 229 in FIG. 2. These examples are not meant to limit the manner in which graphical user interface 229 may be implemented.

For example, one or more of tracks 704 that are for objects of interest may be highlighted or displayed in a different color rather than using cross hatching or icons as described above. In still other illustrative examples, graphical indicators may be used in case a track is not for an object of interest.

In yet other illustrative examples, graphical indicators in the form of animation may be used to draw attention to particular tracks in tracks 704 where objects of interest are present. In yet another illustrative example, if a camera is present at the location where the object of interest is located, the camera is used to generate images of the object for further review by the human operator.

Figure 8:
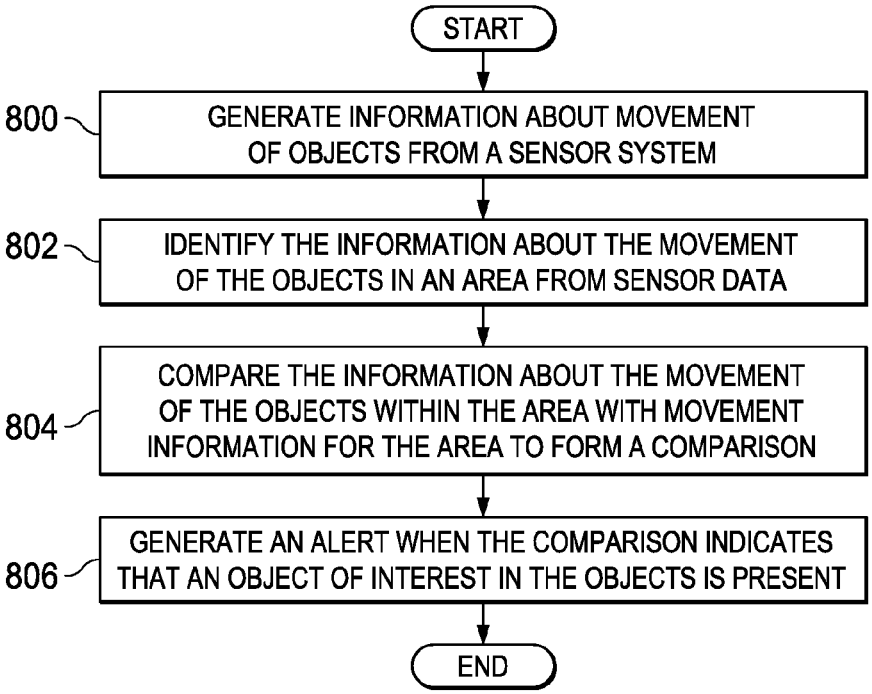
FIG. 8 is an illustration of a flowchart of a process for analyzing movement of objects in accordance with an illustrative embodiment.

With reference next to FIG. 8, an illustration of a flowchart of a process for analyzing movement of objects in an area is depicted in accordance with an illustrative embodiment. The process illustrated in FIG. 8 may be implemented in surveillance environment 200 in FIG. 2. In particular, the different operations performed by the process may be implemented in object analysis system 202.

The process begins by generating information about movement of objects from a sensor system (operation 800). The process identifies the information about the movement of the objects in an area from sensor data (operation 802). The process then compares the information about the movement of the objects within the area with movement information for the area to form a comparison (operation 804).

Next, the process generates an alert when the comparison indicates that an object of interest in the objects is present (operation 806). The process terminates thereafter. In the illustrative example, generating in operation 800, identifying in operation 802, comparing in operation 804, and generating in operation 608 are operations that may be performed while the objects are moving in the border area.

Figure 9:
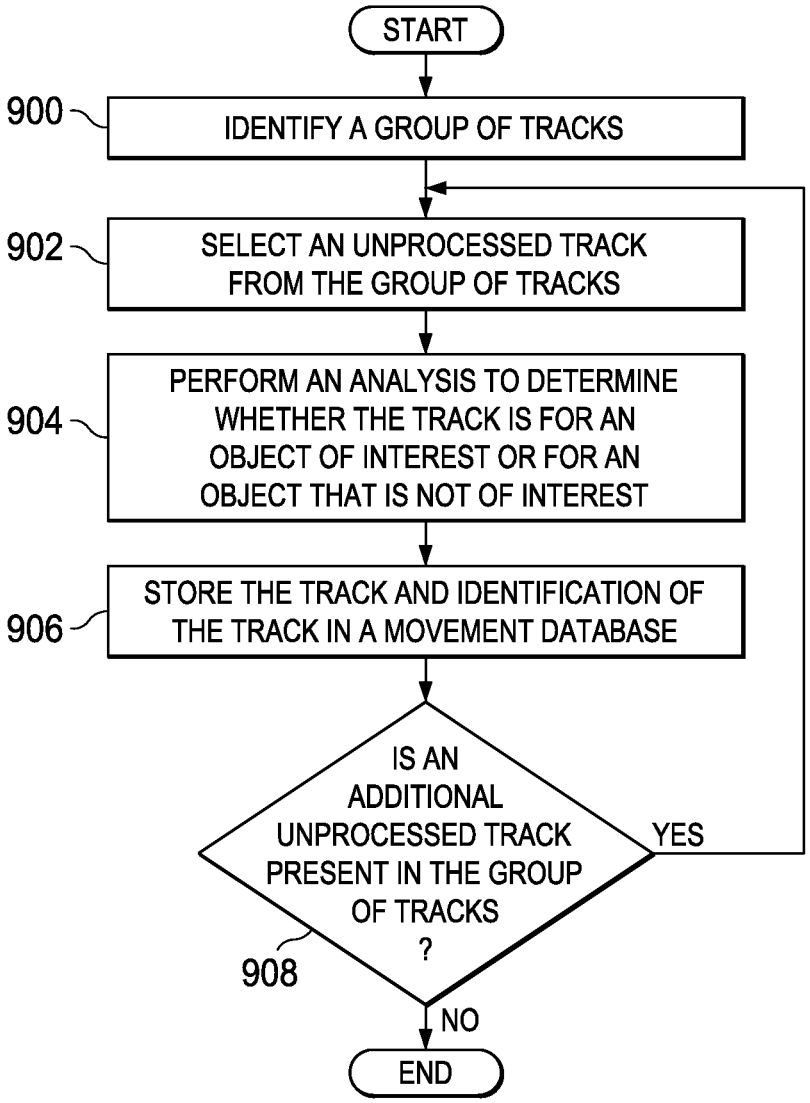
FIG. 9 is an illustration of a flowchart of a process for creating movement information in accordance with an illustrative embodiment.

With reference next to FIG. 9, an illustration of a flowchart of a process for creating movement information is depicted in accordance with an illustrative embodiment. The operations illustrated in FIG. 9 may be used to generate movement information 224 in FIG. 2. These operations may be implemented in computer system 218 or in some other device in FIG. 2.

The process begins by identifying a group of tracks (operation 900). The group of tracks identified in operation 900 may be tracks 222 in FIG. 2. The process selects an unprocessed track from the group of tracks (operation 902).

An analysis is performed to determine whether the track is for an object of interest or for an object that is not of interest (operation 904). The analysis in operation 904 may be performed by a human operator. In some illustrative examples, the analysis may be performed by programs such as an artificial intelligence system, a neural network, a rule based system, a fuzzy logic system, or some other suitable type of process. These different processes may be implemented in object analyzer 212 in the illustrative example.

The track and identification of the track is stored in a movement database (operation 906). In this illustrative example, the movement database may be, for example, movement database 227 in FIG. 2.

A determination is made as to whether an additional unprocessed track is present in the group of tracks (operation 908). If an additional unprocessed track is present, the process returns to operation 902. Otherwise, the process terminates. The process in FIG. 9 may be repeated any number of times to increase tracks that may be used in the movement database for determining whether tracks are for an object of interest.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step. For example, one or more of the blocks may be implemented as program code, in hardware, or a combination of the program code and hardware. When implemented in hardware, the hardware may, for example, take the form of integrated circuits that are manufactured or configured to perform one or more operations in the flowcharts or block diagrams. When implemented as a combination of program code and hardware, the implementation may take the form of firmware.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Figure 10:
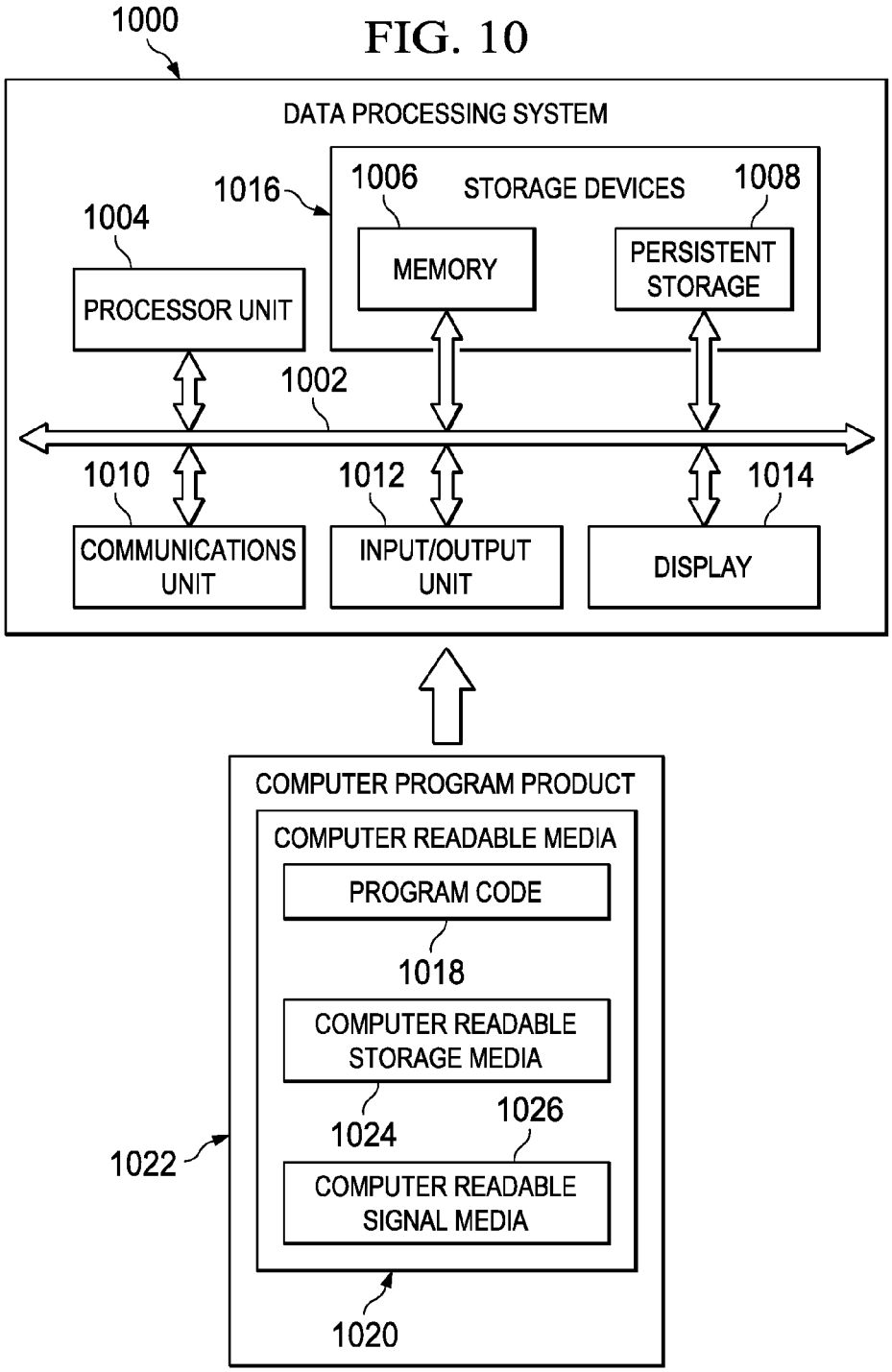
FIG. 10 is an illustration of a block diagram of a data processing system in accordance with an illustrative embodiment.

Turning now to FIG. 10, an illustration of a block diagram of a data processing system is depicted in accordance with an illustrative embodiment. Data processing system 1000 may be used to implement one or more computers in computer system 218 in FIG. 2. In this illustrative example, data processing system 1000 includes communications framework 1002, which provides communications between processor unit 1004, memory 1006, persistent storage 1008, communications unit 1010, input/output (I/O) unit 1012, and display 1014. In this example, communications framework 1002 may take the form of a bus system.

Processor unit 1004 serves to execute instructions for software that may be loaded into memory 1006. Processor unit 1004 may be a number of processors, a multi-processor core, or some other type of processor, depending on the particular implementation.

Memory 1006 and persistent storage 1008 are examples of storage devices 1016. A storage device is any piece of hardware that is capable of storing information, such as, for example, without limitation, data, program code in functional form, and/or other suitable information either on a temporary basis and/or a permanent basis. Storage devices 1016 may also be referred to as computer readable storage devices in these illustrative examples. Memory 1006, in these examples, may be, for example, a random access memory or any other suitable volatile or non-volatile storage device. Persistent storage 1008 may take various forms, depending on the particular implementation.

For example, persistent storage 1008 may contain one or more components or devices. For example, persistent storage 1008 may be a hard drive, a flash memory, a rewritable optical disk, a rewritable magnetic tape, or some combination of the above. The media used by persistent storage 1008 also may be removable. For example, a removable hard drive may be used for persistent storage 1008.

Communications unit 1010, in these illustrative examples, provides for communications with other data processing systems or devices. In these illustrative examples, communications unit 1010 is a network interface card.

Input/output unit 1012 allows for input and output of data with other devices that may be connected to data processing system 1000. For example, input/output unit 1012 may provide a connection for user input through a keyboard, a mouse, and/or some other suitable input device. Further, input/output unit 1012 may send output to a printer. Display 1014 provides a mechanism to display information to a user.

Instructions for the operating system, applications, and/or programs may be located in storage devices 1016, which are in communication with processor unit 1004 through communications framework 1002. The processes of the different embodiments may be performed by processor unit 1004 using computer-implemented instructions, which may be located in a memory, such as memory 1006.

These instructions are referred to as program code, computer usable program code, or computer readable program code that may be read and executed by a processor in processor unit 1004. The program code in the different embodiments may be embodied on different physical or computer readable storage media, such as memory 1006 or persistent storage 1008.

Program code 1018 is located in a functional form on computer readable media 1020 that is selectively removable and may be loaded onto or transferred to data processing system 1000 for execution by processor unit 1004. Program code 1018 and computer readable media 1020 form computer program product 1022 in these illustrative examples. In one example, computer readable media 1020 may be computer readable storage media 1024 or computer readable signal media 1026.

In these illustrative examples, computer readable storage media 1024 is a physical or tangible storage device used to store program code 1018 rather than a medium that propagates or transmits program code 1018.

Alternatively, program code 1018 may be transferred to data processing system 1000 using computer readable signal media 1026. Computer readable signal media 1026 may be, for example, a propagated data signal containing program code 1018. For example, computer readable signal media 1026 may be an electromagnetic signal, an optical signal, and/or any other suitable type of signal. These signals may be transmitted over communications links, such as wireless communications links, optical fiber cable, coaxial cable, a wire, and/or any other suitable type of communications link.

The different components illustrated for data processing system 1000 are not meant to provide architectural limitations to the manner in which different embodiments may be implemented. The different illustrative embodiments may be implemented in a data processing system including components in addition to and/or in place of those illustrated for data processing system 1000. Other components shown in FIG. 10 can be varied from the illustrative examples shown. The different embodiments may be implemented using any hardware device or system capable of running program code 1018.

In this manner, an illustrative embodiment may be implemented for analyzing movement of objects. In particular, tracks identified from sensor data may be analyzed to determine whether these tracks are for objects of interest or objects that are not of interest. In this manner, the use of object analyzer 212 in object analysis system 202 may allow for rejection of ordinary road traffic. In this manner, the number of identifications of objects of interest that turn out to not be objects of interest may be reduced. In some illustrative examples, this process may reduce the number of "false alarms" that occur.

With an illustrative embodiment, an operator, such as operator 203, may more quickly identify suspicious traffic that may need further inspection. Additionally, the amount of assistance needed by operator 203 from object analyzer 212 may be reduced over time as the operator gains experience. Further, with an illustrative embodiment, operators may be moved between different areas more easily with a reduction in false alarms because the operators do not have experience in those new areas.

The description of the different illustrative embodiments has been presented for purposes of illustration and description, and is not intended to be exhaustive or limited to the embodiments in the form disclosed. Many modifications and variations will be apparent to those of ordinary skill in the art. For example, the illustrative examples have described a perimeter such as a border for countries, states, or other political entities. The illustrative examples have also described a perimeter as a boundary for an area such as a group of buildings, a base, or a camp. The illustrative examples may also be applied to perimeters for other boundaries. For example, a perimeter may be a boundary for a road, a field, a portion of a shoreline, a portion of water, or some other suitable geographic or nongeographic area. In other words, a perimeter may be a boundary for any area of interest.

Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for analyzing movement of objects in a border area, the method comprising:

identifying information about the movement of the objects in the border area from sensor data;

comparing the information about the movement of the objects in the border area with movement information for the border area to form a comparison; and generating an alert when the comparison indicates that an object of interest in the objects is present;

wherein the information about the movement of the objects in the border area includes one or more of radar tracks, camera tracks, unattended ground sensor tracks, and smart fence tracks;

wherein the sensor data indicates a presence of the objects, a speed of travel of the objects, and a path along which the objects travel; and wherein the border area is an outdoor area of land.

2. The method of claim 1 further comprising:

generating the information about the movement of the objects from a sensor system.

3. The method of claim 2, wherein the sensor system comprises at least one of a ground radar system, an airborne radar system, a thermal detection system, a satellite system, visible light cameras, infrared cameras, radar systems, motion sensors, pressure sensors, smart fences, and unattended ground sensors.

4. The method of claim 1, wherein the alert is selected from one of a graphical indicator, a sound, or text indicating a presence of the object of interest, graphically indicating a path of movement as being for the object of interest.

5. The method of claim 1, wherein the information about the movement of the objects in the border area includes at least one of a location, a time, and a path.

6. The method of claim 1, wherein the movement information is located in a movement database.

7. The method of claim 1, wherein the movement information comprises at least one of historical movement information or predicted movement information.

8. The method of claim 1, wherein the movement information is selected from at least one of positive movement information indicating a presence of objects of interest and negative movement information indicating an absence of the objects of interest.

9. The method of claim 1, wherein the sensor data is generated by a radar system.

10. The method of claim 1, wherein the identifying, comparing, and generating steps are performed while the objects are moving in the border area.

11. The method of claim 1 further comprising:

generating the information about the movement of the objects from a sensor system;

wherein the sensor system includes a radar system, a thermal detection system, and a satellite system;

wherein the radar system includes one or more of a ground radar system and an airborne radar system;

wherein the thermal detection system is based on one or more of a ground-based thermal detection system and an air-based thermal detection system;

wherein the movement information is selected from at least one of positive movement information indicating a presence of objects of interest and negative movement information indicating an absence of the objects of interest; and wherein the outdoor area of land is between two countries.

12. The method of claim 1, further comprising:

displaying the alert on a graphical user interface;

displaying tracks representing the information about the movement of the objects on the graphical user interface; and displaying a graphical indicator indicating that the tracks are for the object of interest in the objects on the graphical user interface.

13. A method for analyzing movement of objects in an area, the method comprising:

identifying information about the movement of the objects in the area from sensor data;

comparing the information about the movement of the objects in the area with movement information for the area to form a comparison; and generating an alert when the comparison indicates that an object of interest in the objects is present;

wherein the information about the movement of the objects in the area includes one or more of radar tracks, camera tracks, unattended ground sensor tracks, and smart fence tracks;

wherein the sensor data indicates a presence of the objects, a speed of travel of the objects, and a path along which the objects travel; and wherein the area is an outdoor area of land.

14. The method of claim 13 further comprising:

generating the information about the movement of the objects from a sensor system.

15. The method of claim 14, wherein the sensor system comprises at least one of a ground radar system, an airborne radar system, a thermal detection system, a satellite system, visible light cameras, infrared cameras, radar systems, motion sensors, pressure sensors, smart fences, and unattended ground sensors.

16. The method of claim 13, wherein the area is selected from one of a border area, a parking area, a forest, a field, and an underwater area.

17. An apparatus comprising:

an object analyzer configured to:

identify information about movement of objects in a border area from sensor data;

compare the information about the movement of the objects in the border area with movement information for the border area to form a comparison; and generate an alert when the comparison indicates that an object of interest in the objects is present;

wherein the information about the movement of the object in the border area includes one or more of radar tracks, camera tracks, unattended ground sensor tracks, and smart fence tracks;

wherein the sensor data indicates a presence of the objects, a speed of travel of the objects, and a path along which the objects travel; and wherein the border area is an outdoor area of land.

18. The apparatus of claim 17 further comprising:

a sensor system configured to generate the information about the movement of the objects from the sensor system.

19. The apparatus of claim 18, wherein the sensor system comprises at least one of a ground radar system, an airborne radar system, a thermal detection system, a satellite system, visible light cameras, infrared cameras, radar systems, motion sensors, pressure sensors, smart fences, and unattended ground sensors.

20. The apparatus of claim 17, wherein the information about the movement of the objects in the border area includes at least one of a location, a time, and a path.

21. The apparatus of claim 17, wherein the movement information is located in a movement database.

22. The apparatus of claim 17, wherein the movement information comprises at least one of historical movement information and predicted movement information.

* * * * *